US010660163B2

(12) United States Patent
Erisgen

(10) Patent No.: US 10,660,163 B2
(45) Date of Patent: May 19, 2020

(54) INDUCTION STEAM HUMIDIFIER WITH REPLACEABLE CANISTER

(71) Applicant: DRI-STEEM Corporation, Eden Prairie, MN (US)

(72) Inventor: Sukru Erisgen, Eden Prairie, MN (US)

(73) Assignee: DRI-STEEM Corporation, Eden Prairie, MN (US)

( * ) Notice: Subject to any disclaimer, the term of this patent is extended or adjusted under 35 U.S.C. 154(b) by 275 days.

(21) Appl. No.: 15/374,033

(22) Filed: Dec. 9, 2016

(65) Prior Publication Data

US 2017/0171920 A1 Jun. 15, 2017

Related U.S. Application Data

(60) Provisional application No. 62/266,337, filed on Dec. 11, 2015.

(51) Int. Cl.

| | |
|---|---|
| ***H05B 6/10*** | (2006.01) |
| ***H05B 6/12*** | (2006.01) |
| ***H05B 6/36*** | (2006.01) |
| ***F22B 1/28*** | (2006.01) |
| ***F24F 6/02*** | (2006.01) |
| ***H05B 6/06*** | (2006.01) |

(52) U.S. Cl.
CPC ..... *H05B 6/108* (2013.01); *F22B 1/281* (2013.01); *F22B 1/284* (2013.01); *F24F 6/025* (2013.01); *H05B 6/06* (2013.01)

(58) Field of Classification Search
CPC ..... H05B 6/02–08; H05B 6/10; H05B 6/12–1281; H05B 6/36; H05B 6/62
See application file for complete search history.

(56) References Cited

U.S. PATENT DOCUMENTS

| | | | | |
|---|---|---|---|---|
| 5,286,942 | A | 2/1994 | McFadden et al. | |
| 5,821,507 | A * | 10/1998 | Sasaki | H05B 6/1227 219/622 |
| 8,476,562 | B2 | 7/2013 | Swanson | |
| 8,505,497 | B2 | 8/2013 | Lundgreen | |
| 9,967,924 | B2 * | 5/2018 | Heczko | H05B 6/1245 |
| 2006/0278630 | A1 | 12/2006 | Sung et al. | |

(Continued)

OTHER PUBLICATIONS

International Search Report and Written Opinion for Application No. PCT/US2016/065827 dated Mar. 2, 2017.

*Primary Examiner* — Michael A Laflame, Jr.
(74) *Attorney, Agent, or Firm* — Merchant & Gould P.C.

(57) ABSTRACT

An induction humidification system is disclosed. The induction humidification system includes a base having a circumferential induction coil and a removable and replaceable cartridge received within the interior space defined by the induction coil. The canister has a nonmetallic housing, such as a plastic housing, within which a ferromagnetic member having a circumferential sidewall is disposed. When the canister is received within the base, the ferromagnetic member sidewall and the induction coil are radially overlapping such that a current applied to the induction coil causes the ferromagnetic member to be heated which in turn causes water held within the canister to be converted to steam. Once the ferromagnetic member has reached the end of its useful life, the canister can be simply replaced with a new canister that can be received by the original base.

16 Claims, 10 Drawing Sheets

(56) References Cited

U.S. PATENT DOCUMENTS

| | | | | |
|---|---|---|---|---|
| 2009/0065500 | A1* | 3/2009 | England | A47J 27/002 219/621 |
| 2011/0297668 | A1 | 12/2011 | Swanson | |
| 2013/0037537 | A1* | 2/2013 | Sturz | A47J 37/1261 219/628 |
| 2015/0237682 | A1* | 8/2015 | Yaman | H05B 6/1281 219/624 |

* cited by examiner

INDUCTION STEAM HUMIDIFIER WITH REPLACEABLE CANISTER

RELATED APPLICATION

This application claims priority to U.S. Provisional Patent Application Ser. No. 62/266,337, filed on Dec. 11, 2015, the entirety of which is incorporated by reference herein.

BACKGROUND

There are many ways to generate steam for humidification purposes. For example, electrode-type humidifiers produce a small to moderate amount of steam at low pressure (usually atmospheric). In this type of system, electrodes are placed in a plastic tank and electricity is applied to the electrodes directly located in water. As typical water conducts electricity, the water is heated and caused it to boil as the electricity travels through the water between the electrodes. Electrode humidifiers have inherent steam output control limitations. Operation is dependent upon and varies with the water conductivity. Steam output is controlled by draining and filling with water, which adjusts water conductivity and water level. Very low conductivity water such as RO (reverses osmosis) and DI (deionized) renders an electrode humidifier virtually inoperable Electrode humidifiers also require that any connected drain lines either be physically separated from the electrically charged water or that the electrodes be turned off the prevent shock hazards during draining. However, electrode humidifiers are typically lower cost than other steam humidifiers, fail safe under low/no water conditions and have replaceable tanks with electrodes for easier maintenance.

SUMMARY

As described above, electrode humidifiers have a combination of limitations and advantages compared to other steam humidifiers. What is needed in the art is a new steam humidifier that utilizes a replaceable tank like an electrode humidifier combined with excellent steam control independent of water conductivity. The induction humidifier system disclosed herein represents such an improvement.

In one aspect, the humidification system includes a base and a replaceable canister received by the base. The canister has a nonmetallic housing having a circumferential sidewall defining an interior volume. The circumferential sidewall can extending between a bottom drain-fill port for receiving liquid water and a top discharge port for discharging steam. The canister also includes a ferromagnetic member located within the interior volume of the housing. The ferromagnetic member has a circumferential sidewall that has a complementarily shape with the housing circumferential sidewall. The ferromagnetic member can also be provided with a central aperture in fluid communication with the housing drain-fill port. In one aspect, the ferromagnetic member circumferential sidewall and the housing sidewall are radially overlapping, but spaced apart.

The base of the induction humidifier is provided with a circumferential sidewall that defines an interior volume into which the canister housing is received. The base has an induction coil located within the circumferential sidewall that is connected to a power source and control system. When the canister is received into the base, the ferromagnetic member circumferential sidewall is radially overlapping with the induction coil such that when power is applied to the induction coil, the ferromagnetic member is heated which in turn causes water surrounding both sides of the ferromagnetic member to be heated and turn to steam.

DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
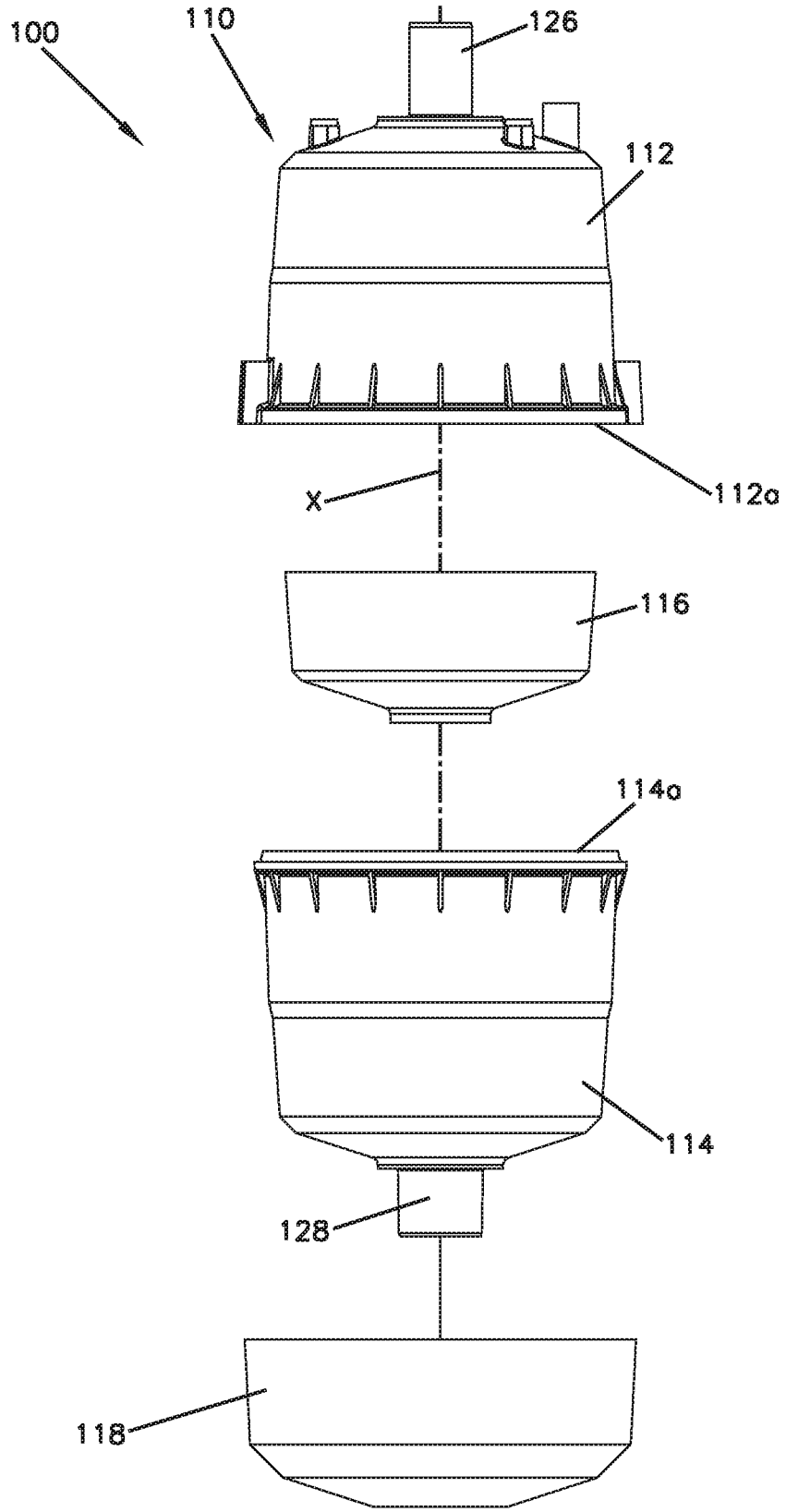
FIG. 1 is a schematic exploded view of a first embodiment of an induction humidification system having features that are examples of aspects in accordance with the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Referring to FIGS. 1 to 4 in the drawings, an induction humidification system 100 is presented. The induction humidification system 100 is for converting water to steam through an induction process in which an induction coil heats a target element in contact with the water. As shown at FIG. 1, the induction humidification system 100 includes a canister 110 having an upper half 112 and a mating lower half 114, a base 118 into which the canister 110 is received, and a ferromagnetic member 116 installed within the canister 110 that acts as a target material for an induction coil (see 122 at FIG. 4) integrated into the base 118. In some embodiments, the ferromagnetic member 116 is provided with a three-dimensional shape, such as a cylindrical tube-shape or a cup-shape.

Figure 4:
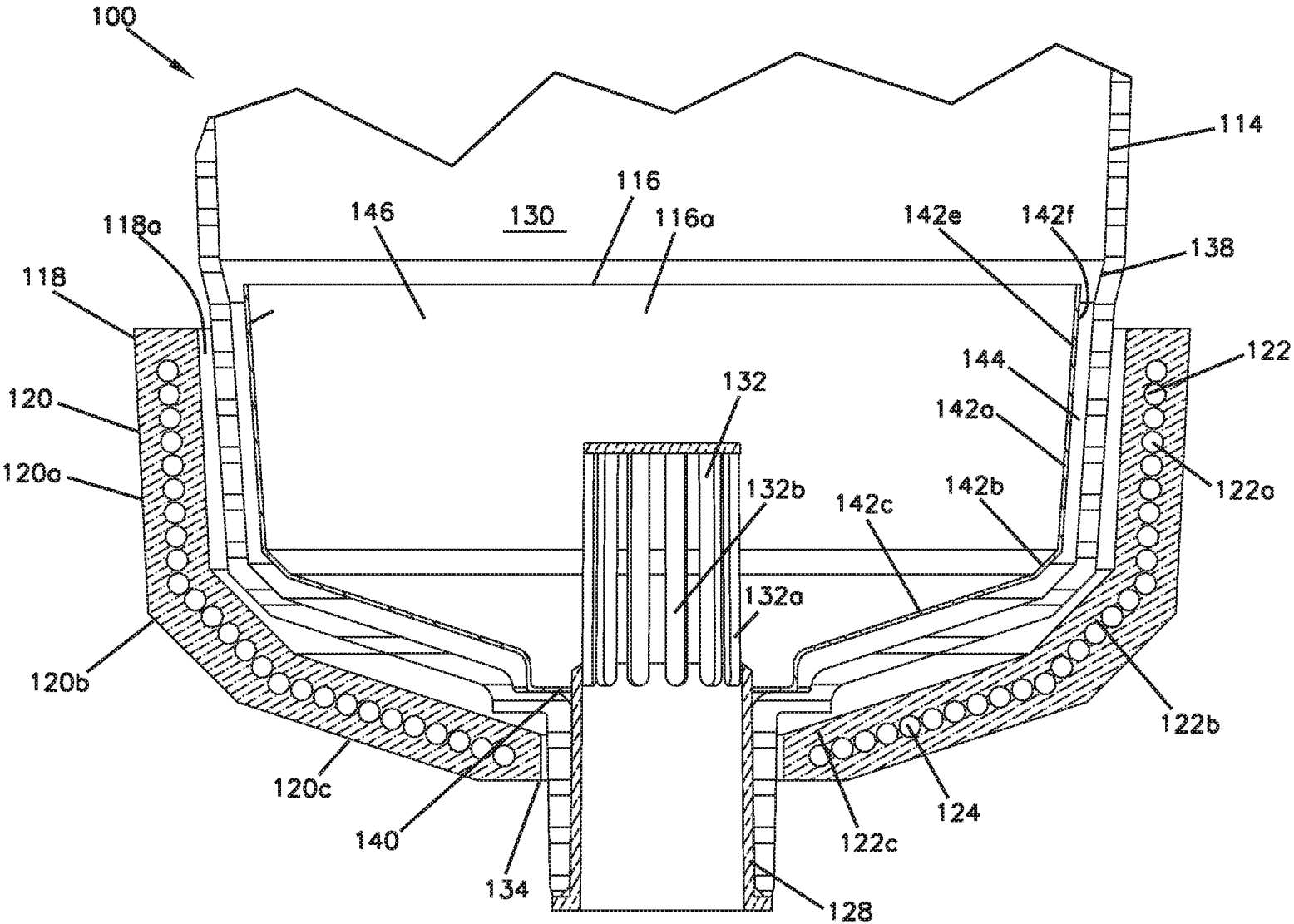
FIG. 4 is a section view of an enlarged portion of the view of the induction humidification system shown in FIG. 3.

The base 118 of the induction humidification system 100 is shown in more detail at FIG. 4 in the drawings. As shown, the base 118 is generally formed in a bowl or a hollow hemispherical shape with an interior portion 118 defined by a circumferential sidewall 120. By use of the term "circumferential sidewall" it is meant to indicate a sidewall that is curved, bent, segmented, or otherwise shaped to define a generally enclosed circumference or perimeter such an interior space or volume within the sidewall can be defined. Many examples of a circumferential sidewall meeting this definition exist. For example, a circumferential sidewall can be curved or segmented in the radial and axial directions to generally form a hollow hemispheric or bowl shape. A circumferential sidewall can also be tapered in the axial direction and curved or segmented in the radial direction to form various shapes, such as a generally conical or frusto-conical shape. A circumferential sidewall can also be formed to define a prismatic shape with any number of adjoining planar sidewall segments such as triangular, rectangular, and pentagonal prisms. A circumferential sidewall can also be formed to have a curved cross-sectional shape, such as a circular, elliptical, or oblong shape. A circumferential sidewall can also be formed from multiple adjoining planar segments disposed at a non-zero angle with respect to each other in the radial and/or axial direction. Combinations of the above noted examples can also be utilized to form a circumferential sidewall.

In the example presented in the drawings, the base 118 is defined entirely by the circumferential sidewall 120 which is formed by three adjoining radially curved portions 120*a*, 120*b*, 120*c*. The third portion 120*c* defines a central aperture 134 through which a drain-fill port 128 of the canister 110 can extend. As shown, the portion 120*a* is very slightly tapered while portions 120*b* and 120*c* are increasingly tapered, wherein each portion has a frustoconical shape. The overall shape defined by the portions 120*a*, 120*b*, and 120*c* can be referred to as a bowl shape or a segmented bowl shape that defines the interior 118. In an alternative arrangement, the sidewall 120 could be formed more simply as a cylindrical shape that is joined by a closed or partially closed end wall (not shown) to form the base 118. However, the configuration shown has beneficial aspects in that it provides a greater opening area for initially receiving the canister 110 and then tapers to guide the canister 110 into the fully received position.

As stated previously, an induction coil 122 is embedded into the sidewall 120 of the base 118. As such, the induction coil 122 has the same general shape as the sidewall 120 and can be said to have sidewall portions 122*a*, 122*b*, and 122*c* corresponding to portions 120*a*, 120*b*, and 120*c* of the sidewall 120. As shown, the induction coil 122 is formed from a continuously wound wire 124, the ends of which are connected to a power source which supplies an alternating current to generate a magnetic field. In one example, a bare copper wire 124 is first wound into the desired shape to form the induction coil 122 which is then placed into a mold. A nonmetallic material, such as a plastic, can then be introduced into the mold to encompass the induction coil 122 and form the base sidewall 120. After curing, a base 118 having an embedded induction coil 122 can be removed from the mold. When an electric current is applied to the induction coil 122 the electromagnetic field will be directed towards the interior 118 of the base 118. Other configurations can also be utilized in which the coil 122 is not embedded into another material.

Referring back to FIG. 1, it can be seen that the first housing part 112 is provided with a discharge port 126 while the second housing part 114 is provided with a drain-fill port 128. Each of the first and second housing parts 112, 114 are formed from a nonmetallic material, such as a plastic. Accordingly, the magnetic field generated by the induction coil 122 will pass through the housing parts 112, 114 without causing them to be heated. The first and second housing parts 112, 114 can be mated together at their respective open ends 112*a*, 114*a* to form an interior space or volume 130. The parts 112, 114 can be either permanently joined or non-permanently joined. Non-limiting examples of a permanently joined connection are joining by welding (e.g. vibration, resistance, ultrasonic, laser, hot gas welding etc.), adhesives, or by fasteners that are incapable of being released once installed. Non-limiting examples of a non-permanently joined connection are joining by releasable fasteners, clamps, and latches.

The first and second housing parts 112, 114 are also at least partially defined by a respective circumferential sidewall 136, 138. The first housing part circumferential sidewall 136 extends between the discharge port 126 and the first housing part open end 112*a* while the second housing part circumferential sidewall 138 extends between the drain-fill port 128 and the second housing part open end 114*a*. The second housing part circumferential sidewall 138 is complementarily shaped with the base circumferential sidewall 120 meaning that a majority of the radially overlapping portions of each (when the canister 110 is received into the base 118) are at least more parallel to each other than orthogonal. By use of the term "radially overlapping" it is meant that a line extending orthogonally from the central axis X of the system 100/canister 110 will pass through both of the overlapping components. This complementarily shaped configuration allows the canister 110 to be fully received into the interior portion 118 defined by the base 118 such that the drain-fill port 128 extends through the central aperture 134 defined by the base 118 and such that the base circumferential sidewall 120 is radially overlapping with a portion of the second housing part circumferential sidewall 138.

As most easily seen at FIG. 4, the drain-fill port 128 can include a strainer 132. The strainer 132 is for preventing debris from reaching the interior volume 130 of the canister 110 from a connected drain-fill line. As shown, the strainer 132 is a separate component that is inserted through the drain-fill port 128 and projects inwardly from the drain-fill port 128 into the interior volume 130 of the canister 110. The strainer 132 is formed with a tubular or generally cylindrical shape with radially spaced slots 132*b* disposed in a circumferential sidewall 132*a*. A flange is also provided at the open end of the strainer 132 such that the strainer 132 cannot be inserted too far through the drain-fill part. Other means for preventing contaminants from entering the interior volume may also be utilized, for example, screens, meshes, and filters.

Before the housing parts 112, 114 are joined together, the ferromagnetic member 116 is installed into the second housing part 114. The ferromagnetic member 116 forms a central aperture 140 through which the strainer 132 can project and through which water from the drain-fill port 128 can pass. The ferromagnetic member 116 can be formed from any material including ferromagnetic metals, for example, 400 series stainless steel and mild, medium, and high carbon steels.

In one aspect, the ferromagnetic member 116 is provided with a circumferential sidewall 142 defining an interior space 146. The circumferential sidewall is complementary in shape to the both the second housing part circumferential sidewall 138 and the base circumferential sidewall 120. In one aspect, the circumferential sidewall 142 has parts 142*a*, 142*b*, and 142*c* which are generally parallel to parts 120*a*, 120*b*, and 120*c* of the circumferential sidewall 120 when the ferromagnetic member 116 is installed into the canister 110 and when the canister is installed into the base 118. Accordingly, once these components are installed together, the circumferential sidewall 142 is radially overlapping with the induction coil 122. This radial overlap enables the induction coil 122 to heat the ferromagnetic member 116 once a current is supplied to the induction coil 122 such that the ferromagnetic member 116 can in turn heat the water present in the canister 116 and convert the water to steam.

The ferromagnetic member 116 is installed within the second housing part 114 such that a gap 144 exists between the cup-shaped sidewall 142 and the second housing part sidewall 138. In one embodiment, the gap 144 is about ⅛ to ⅜ inches wide. Accordingly, a first side 142*e* of the sidewall 142 and an opposite second side 142*f* of the sidewall 142 are both in contact with the liquid water present in the canister 110. This configuration effectively doubles the surface area of the ferromagnetic member 116 that can be used for heating the water, thus increasing the overall effectiveness of the system 100. Additionally, the gap 144 provides an insulating space (i.e. air or water) to protect the second housing part 114 from being directly exposed to the heated ferromagnetic member 116, which could melt the housing part 114 absent the gap 144. The ferromagnetic member 116 is secured within the housing by attaching to side clips or press-fitting the member 116 onto the base 114. The ferromagnetic member can be further secured with adhesives or fasteners to the base 114 to prevent free floating in the water and/or vibrating under an electromagnetic field. Water level control will control the amount of water in the volume 130 to prevent ferromagnetic member being energized without water. Water present in the gap 144 will absorb the heat and prevent the plastic housing 110 from overheating.

The circumferential sidewall 142 can be provided with a continuous, solid circumferential sidewall 142 or can be provided in other configurations. For example, the circumferential sidewall 142 can be provided with slots extending between the central aperture 140 and the open end 116*a* of the member 116. Additionally the circumferential sidewall could be formed from a mesh, screen, or an expanded metal, or could be otherwise perforated (i.e. via punching). Such features can allow for water to travel to both sides of the sidewall 142 to ensure water does not become trapped between the sidewall 142 and the second housing part 114. Furthermore, the circumferential sidewall 142 can be provided with a relatively smooth surface, as shown, or can be provided with an enhanced surface. An enhanced surface is a non-smooth surface, such as one with ridges, bumps, indentations, embossed surfaces, and/or nucleation sites, provided to increase the contact surface area with the water for increased boiling performance. One example of an enhanced surface provided with nucleation sites usable for the circumferential sidewall 142 of the member 116 is shown and described in U.S. Pat. No. 8,505,497, issued Aug. 13, 2013, the entirety of which is incorporated by reference herein.

Figure 1A:
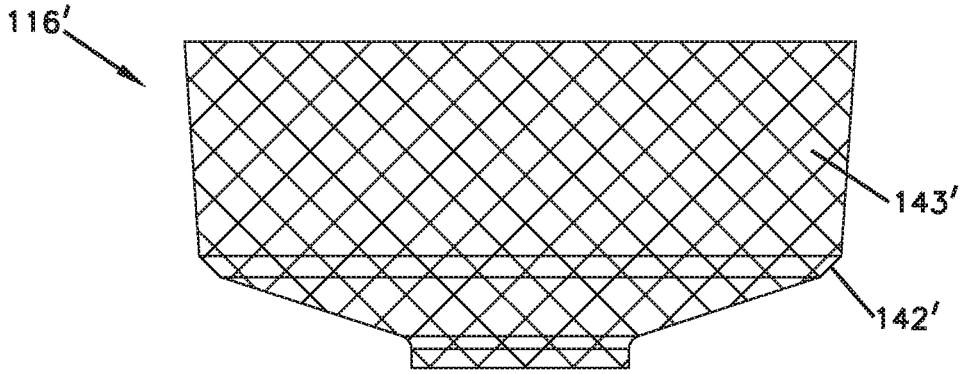
FIG. 1A shows a ferromagnetic member usable in the humidification system shown in FIG. 1.
Figure 1B:
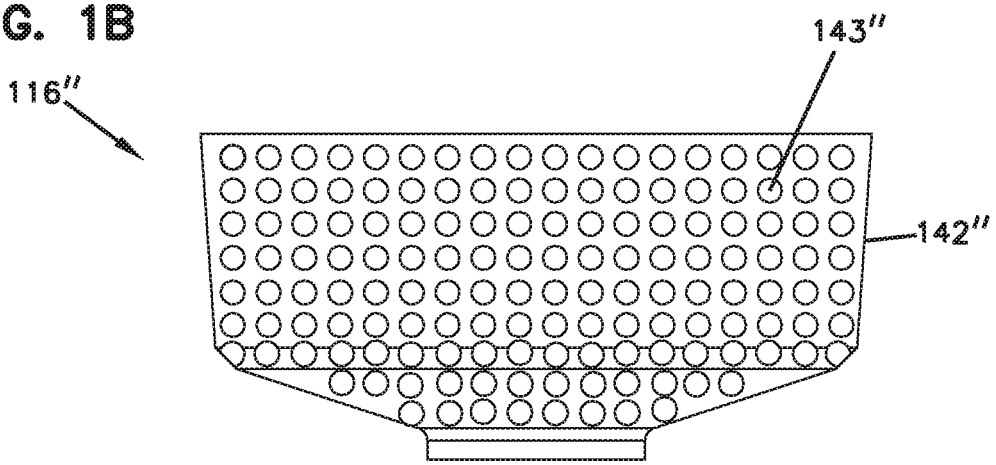
FIG. 1B shows a ferromagnetic member usable in the humidification system shown in FIG. 1.
Figure 1C:
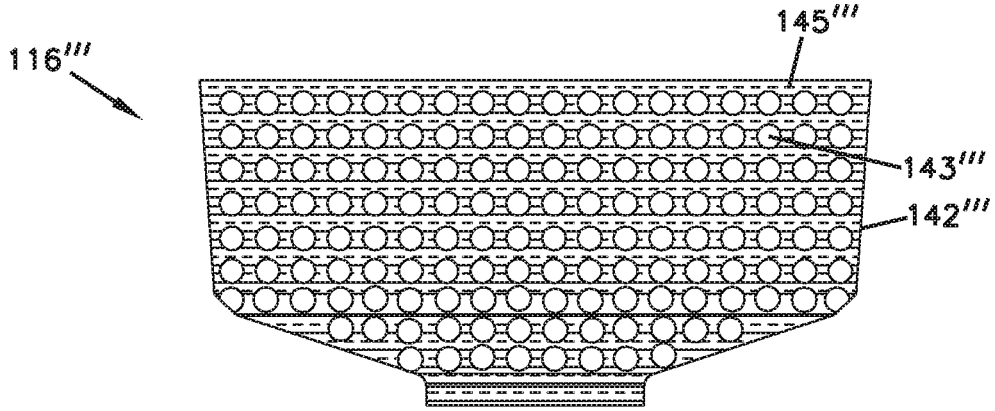
FIG. 1C shows a ferromagnetic member usable in the humidification system shown in FIG. 1.
Figure 3:
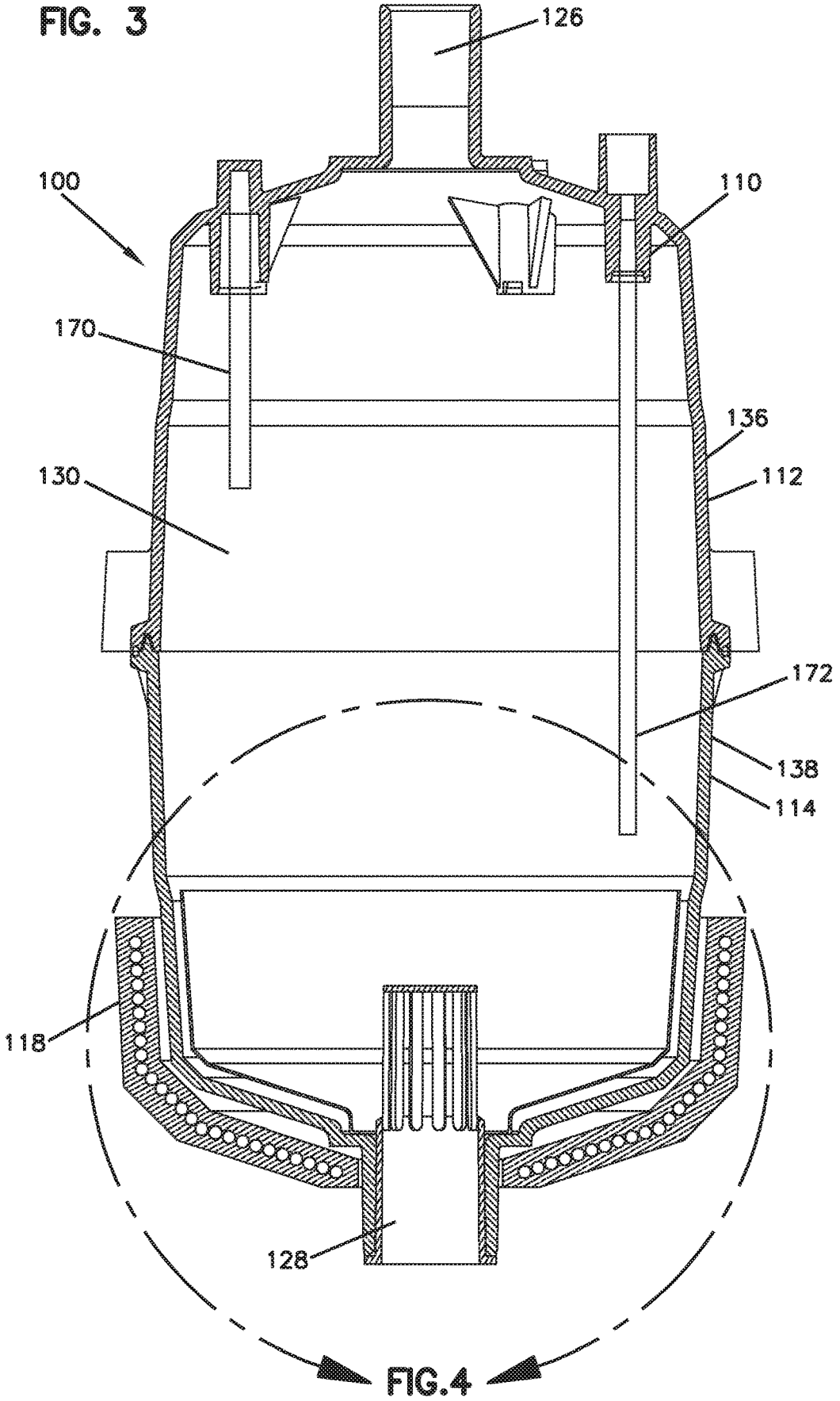
FIG. 3 is a section view of the induction humidification system shown in FIG. 2, taken along the line 3-3 in FIG. 2.

In the example shown at FIGS. 1 and 3-4, the ferromagnetic member 116 is provided with a solid, impermeable metallic sidewall 142. In the example shown at FIG. 1A, a ferromagnetic member 116' is shown in which the sidewall 142' is formed form expanded metal, thereby providing a plurality of apertures 143' in the sidewall 142' through which water may flow. In the example shown at FIG. 1B, a ferromagnetic member 116" is shown in which the sidewall 142" is formed form perforated metal, thereby providing a plurality of apertures 143" in the sidewall 142" through which water may flow. In the example shown at FIG. 1C, a ferromagnetic member 116' is shown in which the sidewall 142'" is formed form perforated metal having an enhanced surface 145', thereby providing a plurality of apertures 143" in the sidewall 142" through which water may flow. The enhanced surface may be of any of the types described above, including nucleation sites of the nature described in U.S. Pat. No. 8,505,497.

Figure 1D:
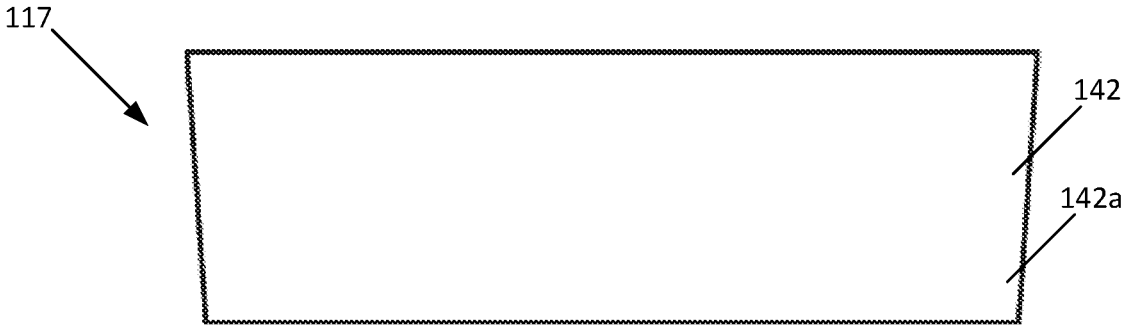
FIG. 1D shows a ferromagnetic member usable in the humidification system shown in FIG. 1.
Figure 1E:
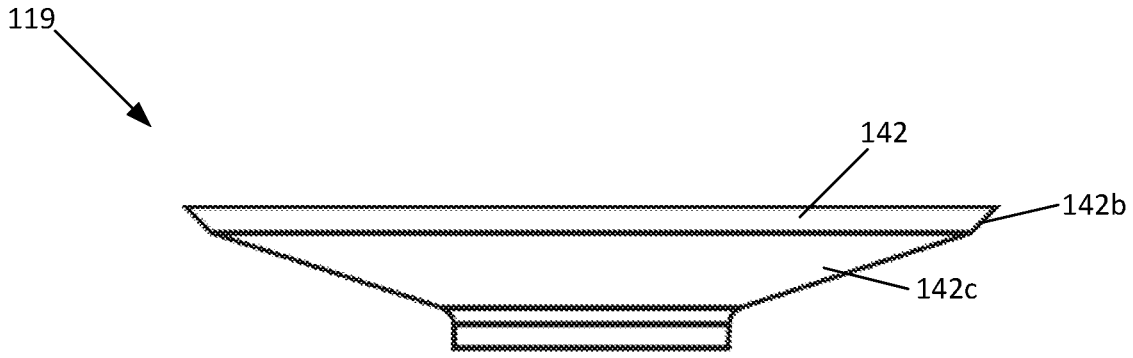
FIG. 1E shows a ferromagnetic member usable in the humidification system shown in FIG. 1.
Figure 1F:
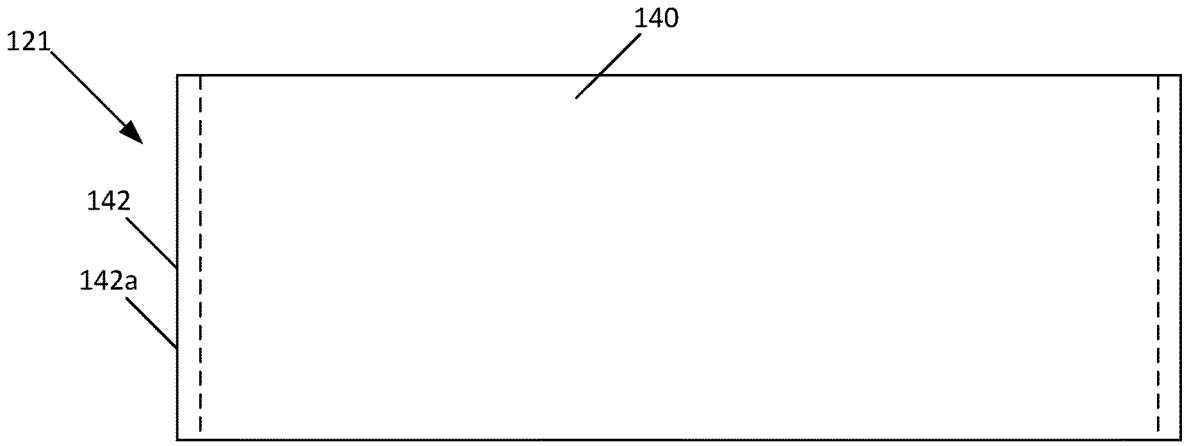
FIG. 1F shows a ferromagnetic member usable in the humidification system shown in FIG. 1.
Figure 1G:
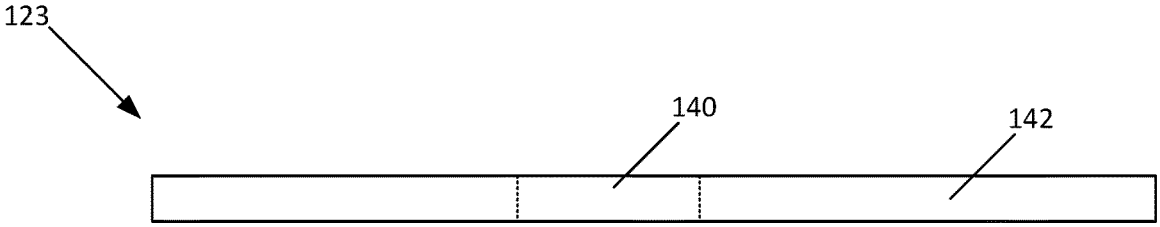
FIG. 1G shows a ferromagnetic member usable in the humidification system shown in FIG. 1.
Figure 2:
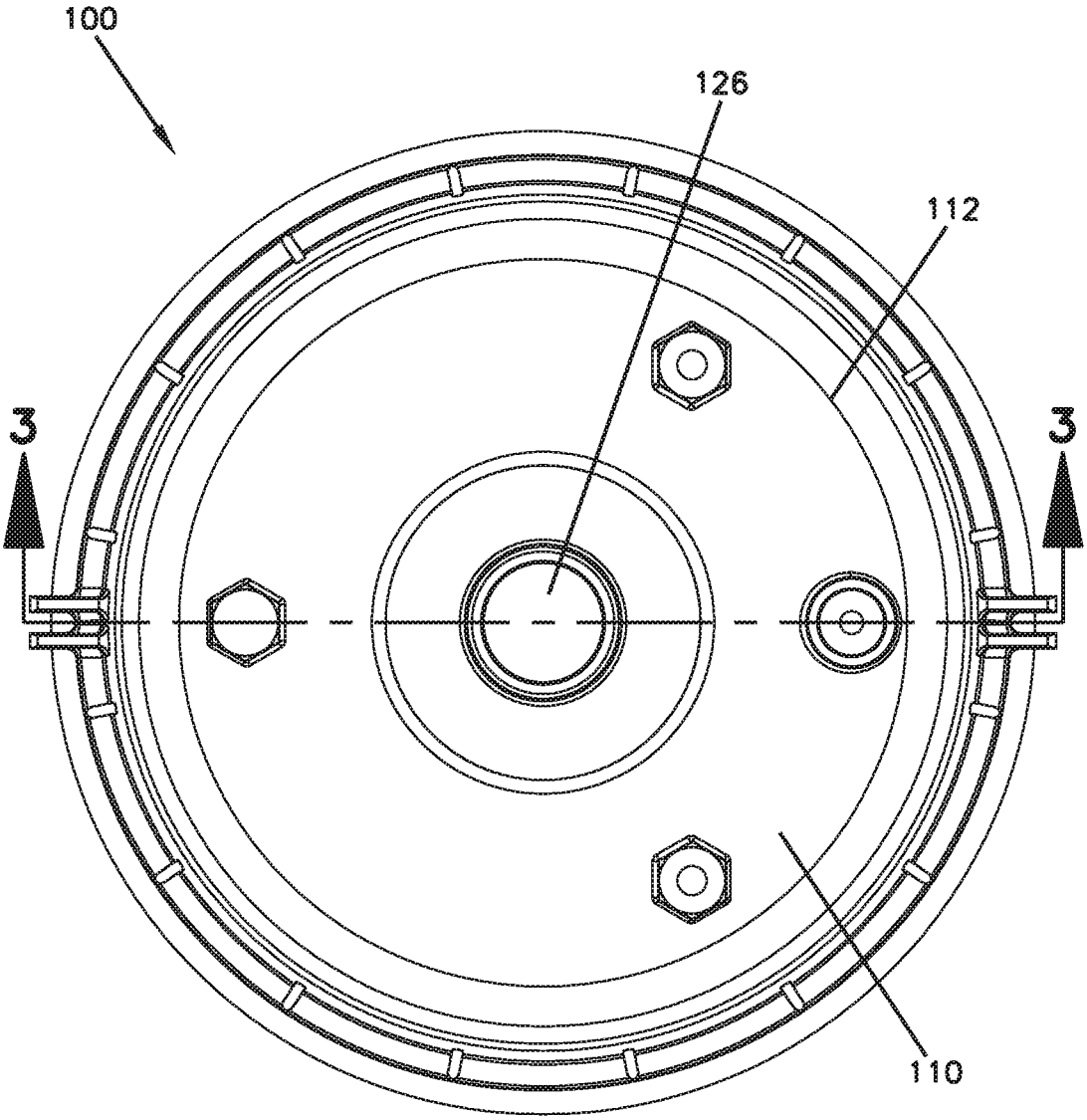
FIG. 2 is a top view of the induction humidification system shown in FIG. 1.

With reference to FIGS. 1D and 1E, the induction humidification system 100 may be configured such that only a portion of the sidewall 142 of the ferromagnetic member 116 is provided. For example, FIG. 1D shows a ferromagnetic member 117 including only the circumferential sidewall portion 142*a* while FIG. 1E shows a ferromagnetic member 119 including only the circumferential sidewall portions 142*b* and 142*c*. Ferromagnetic member 119 could also be configured such that it only includes circumferential sidewall portion 142*c*. FIGS. 1F and 1G show even further alternatives in which a ferromagnetic member 121 is formed as an entirely cylindrical sidewall portion 142*a* and in which a ferromagnetic member 123 is formed as a flat plate. Ferromagnetic member 121 can be differently shaped as well, for example, the ferromagnetic member can be provided with a frustoconical shape or a curved shape. Likewise, the ferromagnetic member 123 need not be a perfectly flat plate, but can be slightly angled or curved in some instances. For both ferromagnetic members 121 and 132, the depicted embodiments are preferable from a manufacturability standpoint in that they are relatively simple shapes to produce from a metal sheet without requiring extensive fabrication steps. As previously discussed with respect to the ferromagnetic member 116, the surfaces of the ferromagnetic members 117, 119, 121, and 123 may be provided as described in reference to FIGS. 1A to 1C.

Figure 4A:
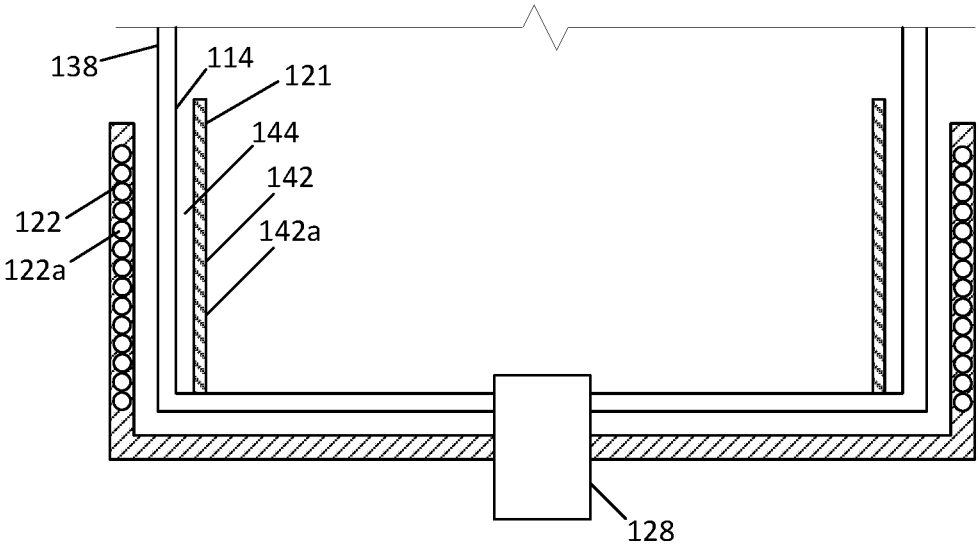
FIG. 4A is a schematic section view of the induction humidification system shown in FIG. 1, utilizing the ferromagnetic member of FIG. 1F.

With reference to FIG. 4A, a variation of the induction humidification system 100 is shown in schematic form in which the ferromagnetic member 121 is used instead of the ferromagnetic member 116. In this example, the ferromagnetic member 121 is spaced away from the sidewall 138 of the housing part 114 such that the ferromagnetic member 121 can advantageously heat water on each side of the sidewall 142*a*. The induction coil 122 is also shown as only including section 122*a* since there is no bottom portion associated with the ferromagnetic member 121. The resulting structure is an induction coil 122 that is generally parallel to the sidewall 142 of the ferromagnetic member 121. As shown in FIG. 4A, the coil 122 and sidewall 142 are completely parallel and extend parallel to the longitudinal axis X. However, the sidewall 142*a* and coil 122 may be presented at an oblique angle to the axis X and may also be less than completely parallel to each other provided they are at least more parallel than not.

Figure 4B:
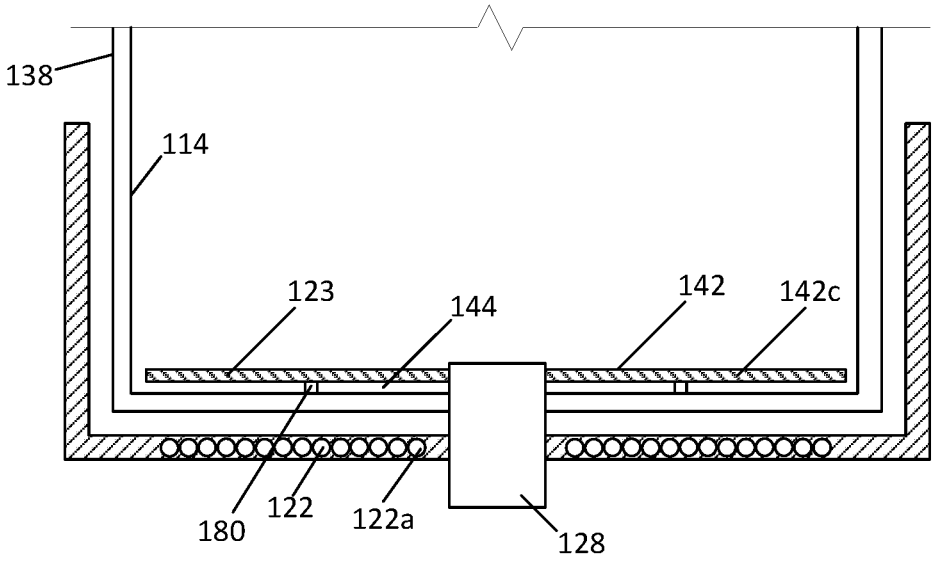
FIG. 4B is a schematic section view of the induction humidification system shown in FIG. 1, utilizing the ferromagnetic member of FIG. 1G.
Figure 5:
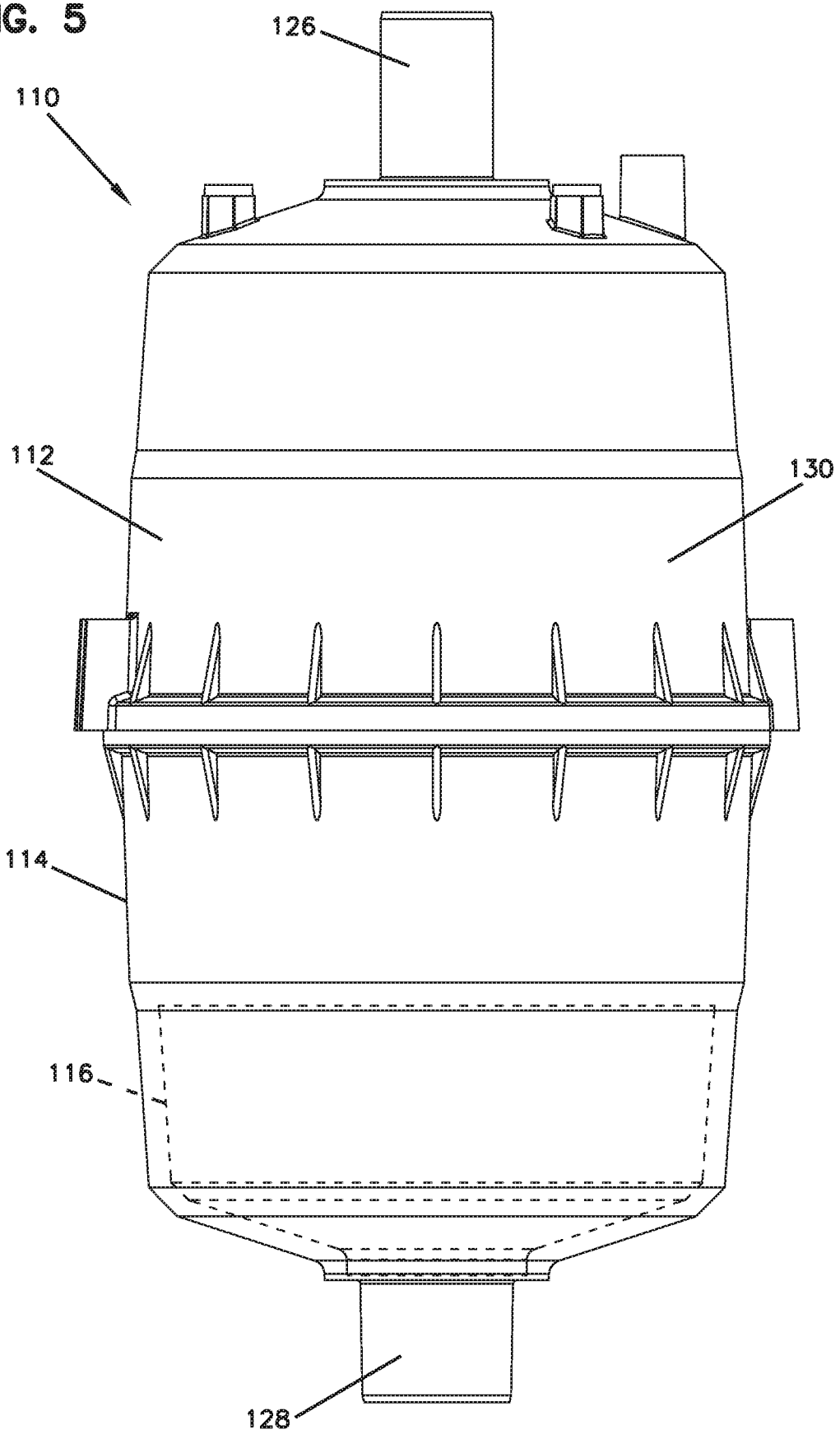
FIG. 5 is a side view of the canister of the induction system shown in FIG. 1.

With reference to FIG. 4B, another variation of the induction humidification system 100 is shown in schematic form in which the ferromagnetic member 123 is used instead of the ferromagnetic member 116. In this example, the ferromagnetic member 123 is spaced away from the sidewall 138 of the housing part 114 such that the ferromagnetic member 121 can advantageously heat water on each side of the sidewall 142*c*. To provide this spacing, the sidewall 138 can be provided with stand-offs 180. Alternatively, the ferromagnetic member 121 can be provided with stand-offs 180. In one example, the stand-offs 180 are bent metal tabs that are an integral part of the ferromagnetic member 121. The induction coil 122 is also shown as only including section 122*c* since there is no side portion associated with the ferromagnetic member 123. The resulting structure is an induction coil 122 that is generally parallel to the sidewall 142 of the ferromagnetic member 121. As shown in FIG. 4B, the coil 122 and sidewall 142 are completely parallel and extend orthogonally to the longitudinal axis X. However, the sidewall 142*c* and coil 122 may be presented at an oblique angle to the axis X and may also be less than completely parallel to each other provided they are at least more parallel than not.

Figure 6:
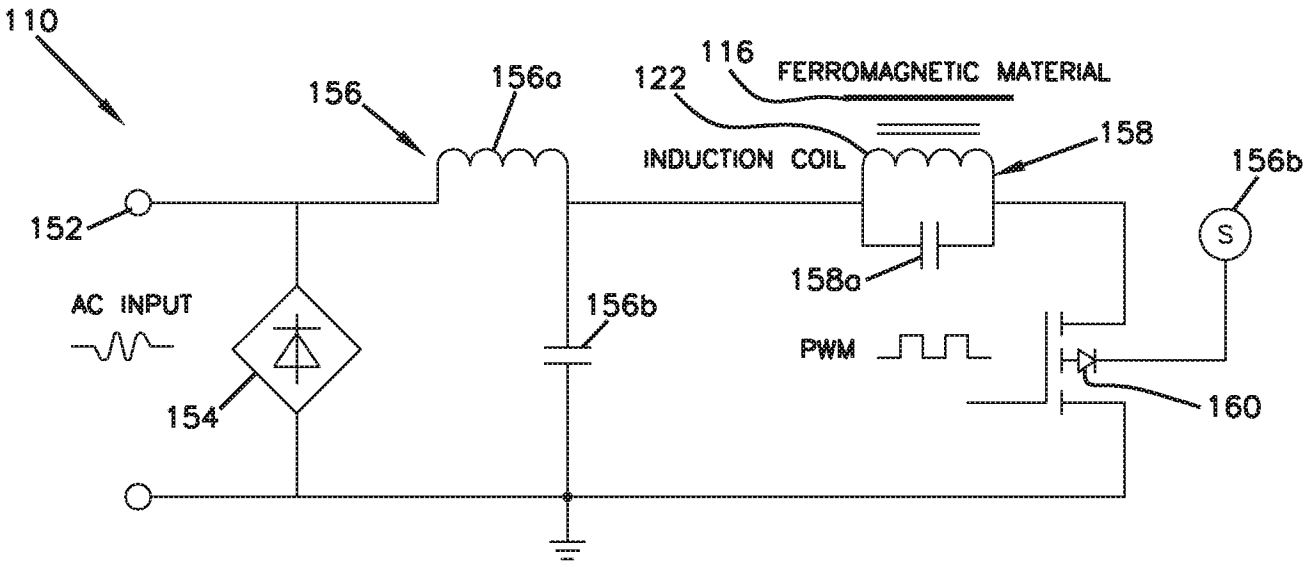
FIG. 6 is a schematic view of a control circuit for the induction humidification system shown in FIG. 1.

The induction humidification system 100 may be provided with a control system or circuit 150 to control the operation of the induction coil 122 to obtain the desired steam output (i.e. boiling rate) and to ensure safe operation. Referring to FIG. 6, a schematic of an electronic drive control circuit 150 is shown in which, in very simple terms, an AC power source 152 is connected to a bridge rectifier module 154 to convert the AC input signal to a pulsating DC signal. The circuit 150 can also include an input line filter 156 (i.e. DC link filter) having a resistor 156*a* and capacitor 156*b*. The circuit 150 further includes an induction circuit 158, configured as a simple parallel resonant circuit (tank circuit), having the induction coil 122 and a capacitor 158*a*. The circuit 150 can also be provided with a pulse width modulation (PWM) microcontroller 160 including an IGBT/MOSFET to control the duty cycle of the circuit 150.

To prevent the plastic canister 110 from melting, a low water lever sensor 172 can also be provided to ensure the ferromagnetic member 116 is not energized when the system is dry or there is not enough water. A high water level sensor 170 may also be provided to establish a maximum fill volume and to ensure that the water level is maintained at a level between the sensors 170, 172. The water level sensors 170, 172 can also be utilized to ensure a certain fill level is maintained that corresponds to a specified amount of stored water. By monitoring the amount of power being sent to the induction coil 122, an approximate boiling rate can be calculated based on the volume of water present at the fill level. Thus, the control circuit 150 can control the boiling rate of the system 100 to meet any desired set point by adjusting the power sent to the induction coil 122.

With the disclosed induction humidification system 100, water conductivity and purity don't affect the boiling rate in a significant way. As such, RO and DI water can be used to eliminate mineral deposits within the cylinder, and especially on the ferromagnetic member 116, eliminating some of the inherent design issues of electrode humidifiers. Additionally, as the water boils off within the canister 110, the water conductivity increases. Since there is no electric current within the water, increased water conductivity has no effect to the performance of the disclosed humidifier. Therefore the otherwise necessary drain cycle can be reduced or eliminated. The reduction or elimination of drain cycle increases water efficiency of such systems. As disclosed, the induction humidification system 100 combines tight output control, RO/DI water capabilities, and the safety of electric resistive units with the replaceable tank features of electrode-type units. As such, the disclosed system 100 represents a significant advancement in humidifier technology.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

What is claimed is:

1. An induction-based steam humidifier system comprising:

(a) a base having a first circumferential sidewall defining a first interior volume, the base having an induction coil located within the first circumferential sidewall, the base including a drain-fill port extending into the first interior volume;

(b) a replaceable canister removably received by the base, the canister including:

i. a nonmetallic housing having a second circumferential sidewall defining a second interior volume;

ii. a ferromagnetic member having a third circumferential sidewall, the ferromagnetic member being located within the second interior volume such that the second and third circumferential sidewalls are radially overlapping;

iii. a central opening defined within a bottom portion of the replaceable canister, the central opening receiving the drain-fill port; and iv. a top discharge port for discharging steam generated within the interior volume, the discharge port being defined within an upper portion of the replaceable canister;

(c) wherein when the replaceable canister is received within the base first interior volume and the induction coil is activated, the third circumferential sidewall is radially overlapping with the induction coil such that the third circumferential sidewall is heated to generate steam from water introduced into the interior volume via the drain-fill port and to discharge steam from the top discharge port.

2. The induction-based steam humidifier system of claim 1, wherein induction humidifier system includes an electronic controller.

3. The induction-based steam humidifier system of claim 1, wherein the nonmetallic housing of the canister is formed from a plastic material.

4. The induction-based steam humidifier system of claim 3, wherein the ferromagnetic member is formed from steel.

5. The induction-based steam humidifier system of claim 1, wherein the first circumferential sidewall is formed from a plastic material.

6. The induction-based steam humidifier system of claim 5, wherein the induction coil is embedded within the first circumferential sidewall.

7. The induction-based steam humidifier of claim 1, wherein the ferromagnetic member has apertures extending from a first side of the ferromagnetic member to a second side of the ferromagnetic member.

8. The induction-based steam humidifier of claim 1, wherein the ferromagnetic member has a surface including one or more of ridges, bumps, indentations, embossed surfaces, and nucleation sites.

9. The induction-based steam humidifier of claim 1, wherein at least a portion of the second and third circumferential sidewalls are spaced apart and separated by a gap such that water stored within the canister is exposed to a first side and an opposite second side of the ferromagnetic member.

10. A replaceable canister for an induction-based steam humidification system comprising:

(a) a nonmetallic housing having a first circumferential sidewall defining a first interior volume, the first circumferential sidewall extending between a bottom drain-fill port for receiving liquid water and a top discharge port for discharging steam; and (b) a ferromagnetic member having a second circumferential sidewall complementarily shaped with the first circumferential sidewall, the ferromagnetic member having a central aperture in fluid communication with the drain-fill port and being located within the second interior volume such that the first and second circumferential sidewalls are spaced apart and radially overlapping, wherein the ferromagnetic member, when activated, heats water within the first interior volume to generate steam which is discharged from the top discharge port.

11. The replaceable canister of claim 10, wherein the nonmetallic housing of the canister is formed from a plastic material.

12. The replaceable canister of claim 10, wherein the ferromagnetic member is formed from steel.

13. The replaceable canister of claim 10, wherein the first circumferential sidewall is formed from a plastic material.

14. The replaceable canister of claim 10, wherein the ferromagnetic member has apertures extending from a first side of the ferromagnetic member to a second side of the ferromagnetic member.

15. The replaceable canister of claim 10, wherein the ferromagnetic member has a surface including one or more of ridges, bumps, indentations, embossed surfaces, and nucleation sites.

16. The replaceable canister of claim 10, wherein at least a portion of the first and second circumferential sidewalls are spaced apart and separated by a gap such that water stored within the canister is exposed to a first side and an opposite second side of the ferromagnetic member.

* * * * *